United States Patent [19]

Munch et al.

[11] 4,260,506

[45] Apr. 7, 1981

[54] HYDRAULIC PRESSURE DEVICE UTILIZING BIODEGRADABLE HALOGENATED DIPHENYL METHANES

[75] Inventors: Ralph H. Munch, Webster Groves, Mo.; Quentin E. Thompson, Belleville, Ill.

[73] Assignee: Monsanto Company, St. Louis, Mo.

[21] Appl. No.: 6,720

[22] Filed: Jan. 26, 1979

Related U.S. Application Data

[63] Continuation-in-part of Ser. No. 921,525, Jul. 13, 1978, abandoned, which is a continuation of Ser. No. 824,480, Aug. 15, 1977, abandoned, which is a continuation of Ser. No. 635,524, Nov. 26, 1975, abandoned, which is a continuation-in-part of Ser. No. 582,486, May 30, 1975, abandoned.

[51] Int. Cl.[3] ..... C10M 3/24; H01B 3/24

[52] U.S. Cl. ..... 252/78.1; 252/581

[58] Field of Search ..... 252/78.1, 77; 260/649 DP, 649 F, 649 R

[56] References Cited

U.S. PATENT DOCUMENTS

| | | | |
|---|---|---|---|
| 2,012,302 | 8/1938 | Clark et al. | 260/649 |
| 2,413,170 | 12/1946 | Clark | 252/78.1 X |
| 2,473,985 | 6/1949 | Brooks | 260/649 |
| 2,477,543 | 7/1949 | Markarian | 260/649 |
| 2,600,691 | 10/1952 | Ross et al. | 260/649 |
| 2,623,910 | 12/1952 | Robinson et al. | 252/66 |
| 2,741,598 | 4/1956 | Good | 252/78.1 |
| 3,006,972 | 10/1961 | Fields et al. | 260/649 |
| 3,290,253 | 12/1966 | Blake et al. | 252/78.1 |
| 3,699,177 | 10/1972 | Watts et al. | 260/649 DP |

*Primary Examiner*—Harris A. Pitlick
*Attorney, Agent, or Firm*—Henry Croskell

[57] ABSTRACT

Biodegradable functional fluids useful as dielectric fluids, heat transfer fluids, hydraulic fluids, plasticizers or dye solvents comprise at least one halogenated diphenylmethane compound represented by the structure where each X is individually chlorine, bromine or fluorine; n is a whole number from 1 to 4; each R is individually an alkyl group having from 1 to 5 carbon atoms; and m is zero or a whole number from 1 to 3.

4 Claims, No Drawings

HYDRAULIC PRESSURE DEVICE UTILIZING BIODEGRADABLE HALOGENATED DIPHENYL METHANES

CROSS REFERENCES TO RELATED APPLICATIONS

This application is a continuation-in-part of copending Application Ser. No. 921,525 filed July 13, 1978 now abandoned which is a continuation of Application Ser. No. 824,480 filed Aug. 15, 1977, now abandoned, which is a continuation of Application Ser. No. 635,524 filed Nov. 26, 1975, now abandoned, which is a continuation-in-part of Application Ser. No. 582,486 filed May 30, 1975, now abandoned.

BACKGROUND OF THE INVENTION

1. Field of the Invention

The present invention relates to functional fluids. More particularly, the invention relates to certain chlorinated aromatic compounds having superior fire resistance and biodegradability, and which are especially useful as dielectric fluids or impregnants in electrical capacitors and transformers, heat transfer fluids, hydraulic fluids, plasticizers or dye solvents.

2. Description of the Prior Art

It has become increasingly important that the potential harm to the ecology be minimized in the use of materials as dielectric fluids, heat transfer fluids, hydraulic fluids and the like. For example, a modern dielectric fluid must possess a unique combination of electrical characteristics and physical properties while minimizing adverse environmental effects. Fire resistance is a very desirable property in order to avoid secondary damage should failure of the electrical device cause electrical sparks or excessive heat.

Chlorinated aromatic compounds have long been known and preferred as dielectric fluids for electrical apparatus. The most familiar fluids in this class are known as "Askarels". Askarel dielectric fluids are fire resistant, have a relatively high dielectric constant, and are by far the most widely accepted fluid for use today in electrical capacitors and transformers. Askarel fluids are formulations composed primarily of polychlorinated biphenyls which are sometimes mixed with chlorobenzenes to give particular viscosity characteristics.

Certain of the polychlorinated biphenyls, however, have been discovered to be resistant to natural degradation and, when released into the environment, these materials may enter the life cycle and be potentially harmful to ecology. Even though capacitors and transformers are customarily sealed units and escape of the dielectric fluid (or impregnant) into the environment can be prevented to a large degree, it has nevertheless become desirable to provide an alternate fluid which does not contain a major component having environmental persistence. Such an alternate fluid would also be of interest in other applications where similar environmental concerns exist.

Halogenated aromatic compounds other than polychlorinated biphenyls have been heretofore disclosed as dielectric fluids for electrical apparatus. U.S. Pat. No. 2,617,770, issued Nov. 11, 1952, broadly discloses "halogenated compounds of naphthalene, toluene, benzene, nitro-diphenyl, diphenyl oxide, diphenyl ketone, diphenyl methane, diphenyl ethane, terphenyls and quaterphenyls". Similarly, U.S. Pat. No. 2,410,714, issued Nov. 5, 1946, discloses "chlorinated benzene, chlorinated diphenyl oxide, chlorinated diphenyl methane, chlorinated diphenyl benzene and alkyl derivatives thereof".

U.S. Pat. No. 2,012,302, issued Aug. 12, 1935 to F. M. Clark et al describes various halogenated compounds said to be useful as dielectric media, heat transfer media and lubricants. A wide variety of compositions comprising halogenated compounds in which phenyl groups are linked together by carbon atoms are disclosed.

U.S. Pat. No. 2,600,691, issued June 17, 1952 to S. D. Ross et al discloses a wide variety of halogenated aromatic compounds said to be useful for electrical applications and as heat transfer agents, plasticizers for resins, and modifiers for lubricating oils.

Notwithstanding the early patent disclosures referred to above, wide commercial acceptance of halogenated aromatic compounds as dielectric fluids has been confined through the years to polychlorinated biphenyls. The other known halogenated aromatics having possible utility as dielectric fluids never achieved commercial significance for one or more technical or economic reasons. Thus, recently published efforts to provide alternate dielectric fluids for capacitors and transformers have, for the most part, been directed away from halogenated aromatic compounds because of the environmental persistence incurred with certain of the polychlorinated biphenyls.

It is an object of the present invention to provide electrical devices containing readily biodegradable dielectric fluids. It is a further object of this invention to provide improved electrical capacitors and transformers containing fire resistant, yet readily biodegradable, dielectric fluids.

Still another object of the present invention is to provide fire resistant, readily biodegradable functional fluids having outstanding viscosity properties for use as dielectric fluids, heat transfer fluids, hydraulic fluids, plasticizers or dye solvents. Other objects of this invention will become apparent from the following description and claims.

SUMMARY OF THE INVENTION

It has now been discovered that certain halogenated diphenylmethanes are superior functional fluids for use as dielectric fluids, heat transfer fluids, hydraulic fluids, plasticizers or dye solvents because they combine the necessary functional and physical properties with excellent biodegradability and fire resistance. The functional fluids of this invention comprise at least one halogenated diphenylmethane compound represented by the structure

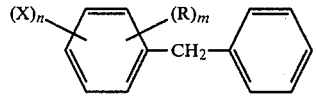

where each X is individually chlorine, bromine or fluorine; n is a whole number from 1 to 4; each R is individually an alkyl group having from 1 to 5 carbon atoms; and m is zero or a whole number from 1 to 3.

This invention provides improved systems and devices which employ the above-described biodegradable compounds as dielectric fluids, heat transfer fluids, hydraulic fluids, plasticizers or dye solvents.

Surprisingly, only those halogenated diphenylmethanes having one unsubstituted phenyl group were found to be readily biodegradable. Those diphenylmethanes with halogen substitution on both phenyl groups, or with halogen on one phenyl and alkyl substitution on the other phenyl, were found to resist microbial degradation. This result was unexpected and the reasons therefor are still not fully understood. The halogenated diphenylmethanes disclosed herein, i.e., those having one unsubstituted phenyl ring, are particularly useful as capacitor impregnants and as dielectric fluids for transformers. In such applications it has been found desirable to employ certain additives such as stabilizers, e.g., epoxide stabilizers. The fluids are also useful in power transmission cables, rectifiers, electromagnets, circuit breakers and the like.

Electrical capacitors containing the halogenated diphenylmethanes of this invention may be constructed and impregnated according to standard procedures. Such capacitors are characterized by a low dissipation factor, high dielectric constant, good low temperature performance, fire resistance and excellent biodegradability of the impregnant itself.

DESCRIPTION OF PREFERRED EMBODIMENTS

The halogenated diphenylmethanes employed in this invention are characterized by halogen substitution in only one aromatic ring. Although alkyl substitution is permissible in the molecule, it must occur in the same ring where the halogen substitution took place. The other phenyl ring must be unsubstituted. While not to be construed in a limiting sense, exemplary compounds having the desired biodegradability coupled with fire resistance and good electrical and physical properties, are o-chlorodiphenylmethane; p-chlorodiphenylmethane; 3,4-dichlorodiphenylmethane; 2,4-dichlorodiphenylmethane; a dichlorodiphenylmethane mixture of the 2,4 and 3,4 isomers; and a trichlorodiphenylmethane mixture of the 2,4,5 and 2,5,6 isomers. Chlorine is the preferred halogen because of its lower cost compared to bromine or fluorine. Tetrahalogenated diphenylmethanes having all halogens within one aromatic ring are also within the present scope. Up to three alkyl groups of 1 to 5 carbon atoms, alike or unlike, may be present in the halogenated ring. Exemplary alkyl-substituted halogenated diphenylmethanes are o-chlorotolylphenylmethane and p-chlorotolylphenylmethane.

Capacitor devices employing the present invention may typically be convolutely wound capacitors comprising separate electrode foils or armatures, intermediate dielectric spacers and terminal connectors having enlarged surfaces in contact with electrode foils. The electrode foils may comprise one or more of a number of different materials, generally metallic and including for example aluminum, copper and stainless steel. The dielectric spacers generally comprise paper and/or polymeric film. The dielectric spacer materials and the voids within and between the materials and the electrode foils are impregnated with a dielectric fluid.

The dielectric spacers may be comprised of a solid flexible porous material such as highly refined cellulose paper, or of a substantially nonporous polymeric film material such as a polyolefin, or of a combination of paper and polymeric film. In a preferred embodiment, the paper material is preferably two or more sheets of Kraft capacitor paper having an individual sheet thickness not greater than about 1.0 mil and preferably about 0.3 mil and a total combined thickness suitable for the design voltage of the capacitor. Such paper has a dielectric strength which is relatively good as compared to other dielectrics and has a relatively high dielectric constant. The polymeric material is preferably biaxially oriented polypropylene film although other members of the polyolefin family, particularly polyethylene and 4-methylpentene-1 have found some use in capacitor applications. Other useful polymeric materials include polyesters, polycarbonates, polyvinylidene fluoride and polysulfone. Although either paper or polymeric film may be used alone, combinations of both are often employed. The paper is positioned adjacent to the polymeric film to function as a wick to pass the dielectric liquid impregnant into the area coextensive with the area of contact between the porous paper and the substantially nonporous polymeric material.

Impregnation of the capacitor is accomplished with conventional procedures. For example, in one general impregnation method, capacitor units encased in assemblies are dried under vacuum to remove residual moisture. The drying temperature will vary depending upon the length of the drying cycle but usually ranges from about 60° to 150° C. With too low a temperature, the drying period is excessively long while too high a temperature may cause decomposition of the paper or shrinkage of the polymeric film utilized as the dielectric spacer. A hole in the assembly permits moisture and gases to vent from the interior of the assembly during the drying process.

The impregnating dielectric liquid is admitted to the capacitor assembly through a hole in the assembly, preferably while the dried assembly is still under vacuum in a suitable evacuated enclosure. The capacitor element within the assembly must be submerged by the impregnating liquid and usually enough of the impregnating liquid is introduced to completely flood the assembly and displace all the air therein. The pressure of the enclosure is then raised to atmospheric pressure and the assembly is permitted to stand or soak for a number of hours for thorough penetration of the liquid impregnant. After impregnation, the capacitor unit may be sealed by applying a quantity of a suitable solder to the hole or by other sealing means. The capacitor assembly may thereafter be subjected to an elevated temperature to increase pressure within the capacitor assembly and aid the impregnation process. Heat and pressure may enhance impregnability by changing the relative wettability, viscosity and solubility of materials. In addition, expansion and contraction of individual components of the system which may be the result of heat and pressure may act as a driving force to induce migration of the liquid into the interstices of the dielectric spacer material.

In addition to the presence of one or more halogenated diphenylmethane compounds, the dielectric fluids of this invention may contain minor amounts of numerous other components. In particular, it is often desirable to include a component to act as a stabilizer in the impregnated dielectric system. The presence of a stabilizer is intended to neutralize certain ionizable contaminants or extraneous materials which may be present or which may be formed in the system. Such contaminants may include residual catalyst or catalyst activators which remain from resin forming reactions. Contaminants may also include degradation products caused by environmental or voltage induced chemical reactions in the system. In certain cases, the stabilizer may act as a scavenger for any hydrogen chloride evolved from the dielectric liquid as a result, for example, of arcing conditions during operation. These undesirable contaminants and extraneous products have an adverse effect on the dissipation factor or power factor of the impregnated dielectric system, and stabilizing agents have been found to be highly effective in maintaining a low power factor in impregnated dielectric systems.

The particular stabilizing agent is dependent in part upon whether the electrical device, for example, the capacitor, is to be employed in alternating current (A.C.) or direct current (D.C.) service. Anthraquinone has exhibited superior results for D.C. service. Particularly preferred stabilizing agents for A.C. applications are epoxides generally characterized by the group

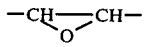

examples of which are glycidyl ethers and derivatives of ethylene oxide. Other examples are 1-epoxyethyl-3,4-epoxycyclohexane, 3,4-epoxycyclohexylmethyl-3,4-epoxycyclohexane carboxylate, 3,4-epoxy-6-methylcyclohexylmethyl-3,4-epoxy-6-methylcyclohexane carboxylate, and the like. These stabilizers are preferably employed in the dielectric fluid compositions of this invention in amounts in the general range of from 0.001 to about 8 percent by weight, and more preferably from about 0.1 to 3.0 percent by weight.

The following Examples illustrate the superiority of electrical apparatus containing dielectric fluids of the present invention wherein all parts and percentages are expressed by weight unless otherwise specified.

EXAMPLE I

Numerous electrical capacitors of the type previously described were constructed of aluminum foil and paper separators and were impregnated according to the foregoing description with a dielectric fluid composition comprising 99.7 percent 3,4-dichlorodiphenylmethane and 0.3 percent 3,4-epoxycyclohexylmethyl-3,4-epoxycyclohexane carboxylate. A group of eight of these capacitors, designated "Test Capacitors", were subjected to service and life tests in a laboratory environment. The results of these tests were compared to those obtained with a like group of identical capacitors impregnated in a like manner with an electrical grade polychlorinated biphenyl containing about 42 percent chlorine, designated as "Control Capacitors". The impregnant for the Control Capacitors contained 0.3 percent 3,4-epoxycyclohexylmethyl-3,4-epoxycyclohexane carboxylate. Test results are presented in the following Table 1.

TABLE 1

LIFE TEST DATA
PAPER INSULATED CAPACITORS*

| | | | | | | | | | |
|---|---|---|---|---|---|---|---|---|---|
| LIFE TEST CONDITIONS | | | | | | | | | |
| Temp. °C. | 22° | 70° | 70° | 70° | 70° | 70° | 80° | 90° | 100° |
| Voltage | 600 | 870 | 900 | 930 | 960 | 1,000 | 1,000 | 1,000 | 1,000 |
| Time, hrs. | 0 | 744 | 168 | 168 | 168 | 168 | 195 | 163 | 168 |
| TEST CAPACITORS | | | | | | | | | |
| - 8 units - | | | | | | | | | |
| Dissipation Factor | .00322 | .00323 | .00321 | .00324 | .00324 | .00332 | .00332 | .00339 | .00367 |
| Capacitance, Microfarads | 2.079 | 2.014 | 2.013 | 2.012 | 2.012 | 2.011 | 2.001 | 1.991 | 1.995 |
| No. of Failures | 0 | 0 | 0 | 0 | 0 | 0 | 0 | 0 | 0 |
| CONTROL CAPACITORS | | | | | | | | | |
| - 8 units - | | | | | | | | | |
| Dissipation Factor | .00310 | .00304 | .00326 | .00303 | .00304 | .00307 | .00330 | .00338 | .00417 |
| Capacitance, Microfarads | 1.938 | 1.869 | 1.868 | 1.867 | 1.867 | 1.867 | 1.855 | 1.845 | 1.826 |
| No. of Failures | 0 | 0 | 0 | 0 | 0 | 0 | 0 | 0 | 7 |

*Two sheets of 0.66 mil Kraft paper

The data in Table 1 illustrate the excellent electrical performance and reliability of capacitors impregnated with a dielectric fluid composition of this invention as compared to like capacitors of the prior art. In particular, Table 1 shows that there were no failures of the test capacitors even though they were subjected to the extreme test conditions of 100° C. and 1,000 volts. The control capacitors, on the other hand, although surviving up to the final test conditions, suffered 87 percent failure at these conditions. That is, 7 of the 8 capacitors in the control group failed while the test capacitors were all still operative.

Halogenated diphenylmethanes of this invention, i.e., those having halogen substitution (and optional alkyl substitution) in only one phenyl ring, are useful as the dielectric fluid for electrical transformers for cooling and insulating purposes. These compounds have the advantage over mineral oil dielectrics because of fire resistance. The additional advantages of excellent biodegradability and outstanding viscosity properties make these halogenated diphenylmethanes attractive in transformer applications.

A typical electrical transformer in which the present invention may be embodied is illustrated in U.S. Pat. No. 3,362,908 issued Jan. 9, 1968. Advantageously, an epoxide stabilizer may be employed in conjunction with the halogenated diphenylmethane for transformer service.

Although halogenated diphenylmethanes were long ago disclosed broadly in the literature as dielectric or insulating fluids for electrical apparatus, there is found little, if any, evidence of their industrial usage or acceptance. Polychlorinated biphenyls assumed through the years the dominant role for halogenated aromatics having fire resistance coupled with outstanding electrical properties. Thus, no understanding was achieved in the art for the good or bad industrial potential of halogenated diphenylmethanes because they were entirely overshadowed by the widespread acceptance of polychlorinated biphenyls. Upon discovery of biodegradability problems associated with certain of the polychlorinated biphenyls, those skilled in the art of dielectric fluids immediately sought alternate fluids other than those in the family of halogenated aromatic compounds.

Despite this discouraging atmosphere, it has surprisingly been discovered that halogenated diphenylmethanes can be superior dielectric fluids for use in electrical apparatus depending upon whether the halogen substitution (and optional alkyl substitution) occurs in one or in both phenyl rings. This discovery was entirely unexpected and was not predictable from prior art teachings. For example, it was entirely unpredictable that a mixture of 2,4 and 3,4-dichlorodiphenylmethane would be highly biodegradable whereas a mixture of 2,4' and 4,4'-dichlorodiphenylmethane would be highly resistant to biodegradation.

Biodegradability has been established as a key factor in determining the environmental persistence of organic compounds or mixtures thereof. Biodegradability is the susceptibility of a compound to degradation by a mixed bacterial population in the presence of a natural energy source, e.g., waste water.

To illustrate the dramatic difference in biodegradability between single ring and double ring substitution in halogenated diphenylmethane compounds, biodegradability testing was conducted on a series of such compounds. Biodegradability testing was carried out using a semi-continuous activated sludge test which was patterned after the test methods for surfactants set forth by the Subcommittee on Biodegradation Test Methods of the Soap and Detergent Association [Jour. Amer. Oil Chemists Soc., 42, 986 (1965)].

In the semi-continuous activated sludge test, biodegradability is measured using activated sludge from a sewage treatment plant as the source of microorganisms. A given level of test compound and a synthetic sewage as an energy source are fed on a periodic basis to the activated sludge contained in a stirred aeration chamber. Aeration of the mixed liquor (activated sludge and liquor) is carried out for "n−1" hours of a "n" hours cycle. Cycle times generally employed are 24, 48 or 72 hours. Representative samples of the mixed liquor are taken shortly after feeding and near the end of the aeration period to determine the disappearance rate of the test compound during the cycle. The cycle is repeated for as long as necessary to obtain consistent biodegradation rate data. The semi-continuous activated sludge test simulates a secondary sewage treatment facility. The following Example II describes details of the biodegradability tests conducted on halogenated diphenylmethanes having single ring substitution and double ring substitution, respectively.

EXAMPLE II

Activated sludge obtained from a typical treatment plant of the Metropolitan Sewer District of St. Louis, Mo. was used in this Example. The mixed liquor as obtained from the sewage treatment plant was filtered through a 20-mesh stainless steel screen to remove any extraneous particulate matter. After adjustment with tap water to a suspended solids content of 2,500 milligrams per liter, 1,500 milliliters of the mixed liquor was charged to an aeration chamber. The aeration chamber was then connected to a compressed air source and the mixture aerated at a 0.1 cubic foot per hour (SCFH) flow rate (0.0028 cubic meters per hours). During the aeration, agitation of the mixed liquor using a magnetic stirrer was also provided. The compound to be tested in the form of either an absolute ethanol or aqueous solution and 10 milliliters of a synthetic sewage used as an energy source for the sludge microorganisms were fed to the chamber at the beginning of each cycle. For materials which have an appreciable disappearance rate, a 24 hour cycle was employed together with a 72 hour cycle on weekends. For the more refractory materials, a basic 48 hour cycle was employed. At the end of the aeration period or cycle, the sludge was allowed to settle and 1 liter of supernatant liquid was removed. The unit was re-fed, the mixed liquor volume adjusted to 1,500 milliliters with tap water, and the aeration cycle repeated. Samples of mixed liquor (e.g., 20 milliliters) were taken through a side-arm stopcock with 25 milliliter graduated cylinders 1 hour after feeding and at the end of the aeration cycle and analyzed for the compound or compounds of interest.

The initial feed rate for the chlorinated diphenylmethanes was 1 milligram per 24 hour cycle. The rate was increased to 3 milligrams the second week and to 5 milligrams the third week. The level was then maintained at 5 milligrams until consistent disappearance rate data were obtained. For those chlorinated diphenylmethanes which degraded rapidly at the 5 milligram level, the feed rate was subsequently increased to 20 milligrams and additional data obtained.

The phrase "disappearance rate" as used herein is synonymous with biodegradation rate or biodegradability. The sampling and analytical procedures employed in the biodegradation rate determinations were as follows. 50 milliliter samples of the mixed liquors were withdrawn after feeding and at the end of the aeration cycle. The amount of chlorinated diphenylmethane in the concentrated extracts was determined using flame-ionization gas chromatography. From the analytical data, the percentage biodegradation was calculated by the equation:

$$\% \text{ Biodegration} = \frac{C_o - C_n}{C_o} \times 100$$

where $C_o$=milligrams of test material in unit at beginning of aeration cycle after feeding of test material $C_n$=milligrams of test material in unit at end of aeration cycle Biodegradation data for 15 halogenated diphenylmethane compounds of Example II are presented in the following Table 2. It can be observed that those halogenated diphenylmethanes having 1 unsubstituted phenyl ring are highly biodegradable, viz. Compounds 1 through 8. In contrast, Compounds 9 through 15 which have halogen or alkyl substitution in both phenyl rings are resistant to biodegradation.

Surprisingly, it does not appear to be the mere presence of halogen in the second phenyl group which inhibits biodegradation. An alkyl group alone can cause the same effect. See Compounds 14 and 15 which are, respectively, o-chlorobenzylethylbenzene and p-chlorobenzylethylbenzene. Presence of an ethyl group in the second ring has inhibited biodegradation compared, for example, with Compounds 7 and 8 where the halogen and the alkyl are in one ring, the second ring being unsubstituted.

TABLE 2

BIODEGRADATION OF HALOGENATED DIPHENYLMETHANES

| Compound No. | Compound Structure | % Biodegradation at a Feed Rate (mg/24 hr.) of: 5 mg | 20 mg |
|---|---|---|---|
| 1 | 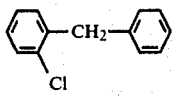 | >97 | >99 |
| 2 | 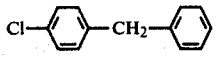 | >97 | >99 |
| 3 | 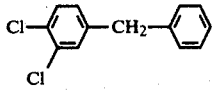 | >97 | >99 |
| 4 | 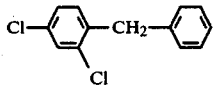 | >97 | 92 ± 3 |
| 5 | 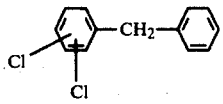 | >97 | >99 |
| 6 | 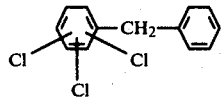 | >99 | — |
| 7 | 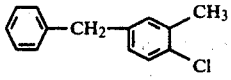 | >98 | 98 |
| 8 | 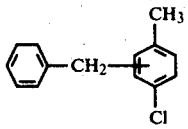 | >98 | 98 |
| 9 | 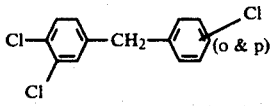 | 10 ± 10 | — |
| 10 | 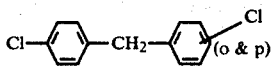 | 8 ±6 | — |
| 11 | 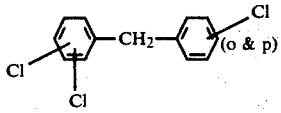 | 6 ± 11 | — |
| 12 | 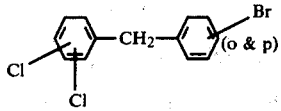 | 1 ± 10 | — |
| 13 | 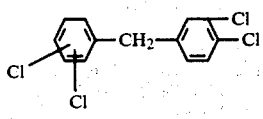 | 8 ± 6 | — |

TABLE 2-continued

BIODEGRADATION OF HALOGENATED DIPHENYLMETHANES

| Compound No. | Compound Structure | % Biodegradation at a Feed Rate (mg/24 hr.) of: 5 mg | 20 mg |
|---|---|---|---|
| 14 | 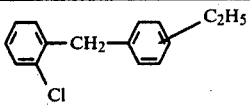 | 24 ± 8 | — |
| 15 | 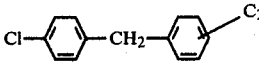 | 22 ± 7 | — |

In the course of the present invention it was further discovered that good biodegradability is not necessarily associated with an unsubstituted phenyl ring in a diaryl compound. For example, pentachlorodiphenyl sulfide, identified herein as Compound No. 17 and having chlorine substitution in both phenyl rings, was found to resist biodegradation but this alone was not considered surprising. Another diphenyl sulfide, however, which was 2,4,5-trichlorodiphenyl sulfide having single ring substitution and identified herein as Compound No. 18, was found to be equally resistant to biodegradation as Compound 17.

It was further discovered that halogen substitution on a phenyl group in a mono-aryl compound does not automatically render that group highly resistant to biodegradation. For example, two different dichlorobenzene compounds, identified herein as Compounds 21 and 22 respectively, exhibited excellent biodegradability.

EXAMPLE III

To illustrate the unpredictability of biodegradation rate among various aromatic structures having 1 to 3 aromatic rings and differing configurations of substitution, 7 compounds other than halogenated diphenylmethanes were tested according to the procedure of Example II. These compounds are identified as Compounds 16 through 22 and their biodegradation results are set forth in Table 3 below.

TABLE 3

BIODEGRADATION OF VARIOUS AROMATIC STRUCTURES

| Compound No. | Compound Structure | % Biodegradation at a Feed Rate (mg/24 hr.) of: 5 mg | 20 mg |
|---|---|---|---|
| 16 | 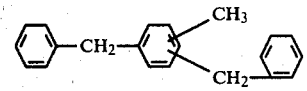 | 48 ± 10 | — |
| 17 | 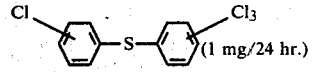 (1 mg/24 hr.) | 11 ± 18 | — |
| 18 | 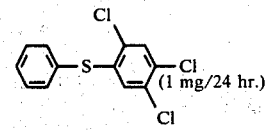 (1 mg/24 hr.) | 7 ± 11 | — |

TABLE 3-continued

BIODEGRADATION OF VARIOUS AROMATIC STRUCTURES

| Compound No. | Compound Structure | % Biodegradation at a Feed Rate (mg/24 hr.) of: 5 mg | 20 mg |
|---|---|---|---|
| 19 | 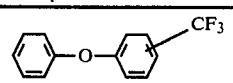 | 68 ± 15 | 35 ± 2 |
| 20 | 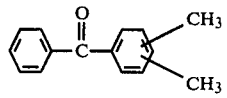 | 85 ± 9 | — |
| 21 | 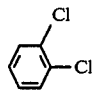 | >95 | — |
| 22 | 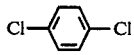 | >97 | — |

The outstanding electrical and biodegradation properties of the single-ring substituted halogenated diphenylmethanes of this invention are evident in Tables 1 and 2 respectively. The following Table 4 presents flammability data on several compounds within the present invention as compared to an electrical grade polychlorinated biphenyl containing about 42 percent chlorine, designated as "Control". It can be seen that certain of the halogenated diphenylmethanes of this invention have a higher flash point than the Control.

TABLE 4

FLAMMABILITY PROPERTIES

| Compound No. | Flash Pt. (°C.) | Fire Pt. (°C.) | A.I.T. (°C.) |
|---|---|---|---|
| 1 | 149 | 193 | 546 |
| 3 | 171–185 | 332 | 559 |
| 4 | 185 | 260 | 581 |
| 6 | 213 | 349 | 597 |
| Control | 180 | None | — |

It is to be understood that the halogenated diphenylmethane dielectric fluid compositions of this invention may incorporate certain compounds in addition to the aforementioned stabilizers in admixture therewith. For example, in order to achieve a particular desired dielectric constant or some other desired property, it may be advisable to add a minor amount of a diaryl sulfone, alkylbenzene, alkyl naphthalene, alkyl biphenyl, alkyl polyphenyl, alkyl aryl ether, diaryl alkane, diaryl ether ester of a carboxylic acid, etc. Thus, the preceding Examples and Tables serve to illustrate preferred embodiments of the present invention but the invention is not to be limited to the compounds, compositions, electrical apparatus or capacitors defined in these Examples.

Because of their outstanding physical properties and fire resistance coupled with excellent biodegradability, the halogenated diphenylmethanes of this invention are useful and valuable in numerous non-electrical applications. For example, the excellent stability and viscosity properties of these halogenated diphenylmethanes make them valuable and useful as fire resistant hydraulic fluids and as heat transfer fluids. One skilled in the art would recognize that a wide variety of devices and systems employ hydraulic fluids or heat transfer fluids. The use of the biodegradable halogenated diphenylmethanes of this invention would be an improvement in such devices or systems in that the potential harm to the ecology in the operation thereof would be minimized.

One skilled in the art would also recognize that when employing the compounds of the present invention as a hydraulic fluid or heat transfer fluid it may be desirable, depending upon the particular device or system involved, to employ the compounds in a composition which contains minor amounts of additives, for example, antiwear additives, corrosion inhibitors, antioxidants, stabilizers and viscosity index improvers. Preferred compositions contain one or more compounds of the present invention in a major amount, i.e., at least 50 percent by weight, with minor amounts of additives. It is also possible to employ as a hydraulic fluid or heat transfer fluid a mixture of one or more compounds of the present invention and other well-known materials having suitable functional fluid properties, again typically with minor amounts of conventional additives.

Exemplary hydraulic pressure devices in which the compounds of this invention may be employed as a hydraulic fluid in the operation thereof are conventional hydraulic pumps and motors, automatic transmissions, hydraulic brakes and clutches, and hydraulic machines, such as lifts, hoists and presses.

Exemplary devices in which the compounds may be employed as heat transfer fluids are reactors and heat exchangers.

In addition, there are certain plasticizer applications where fire retarding properties are desirable. These readily-biodegradable halogenated diphenylmethanes could therefore be employed either as primary plasticizers or as additives for plasticizers.

The fire resistant characteristics of these halogenated diphenylmethanes are not important in all instances. For example, these compounds are useful as dye solvents for pressure-sensitive recording systems wherein a chromogenic dye substance must be dissolved within a microcapsule which is coated on a support sheet. Good biodegradability is essential in such applications.

The single ring substituted halogenated diphenylmethanes of this invention can be prepared according to published procedures well-known to those skilled in the art. For example, a desired chlorinated diphenylmethane compound may be prepared by the reaction of benzene with the corresponding chlorinated benzyl chloride.

What is claimed is:

1. A method of operating a hydraulic pressure device which comprises employing as a hydraulic fluid a biodegradable composition comprising one or more compounds represented by the structure:

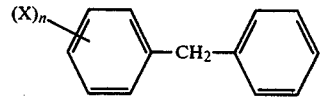

where each X is chlorine; and n is a whole number from 1 to 4.

2. A method in accordance with claim 1 wherein n is 2 or 3.

3. A hydraulic pressure device employing as a hydraulic fluid a biodegradable composition comprising one or more compounds represented by the structure:

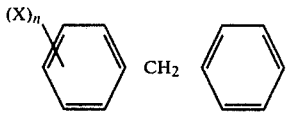
where each X is chlorine; and n is a whole number from 1 to 4.
4. A device in accordance with claim 3 wherein n is 2 or 3.
* * * * *
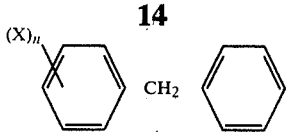
where each X is chlorine; and n is a whole number from 1 to 4.
4. A device in accordance with claim 3 wherein n is 2 or 3.
* * * * *

UNITED STATES PATENT AND TRADEMARK OFFICE

CERTIFICATE OF CORRECTION

PATENT NO. : 4,260,506

DATED : April 7, 1981

INVENTOR(S) : Ralph H. Munch, et al

It is certified that error appears in the above-identified patent and that said Letters Patent are hereby corrected as shown below:

Delete column 14 in its entirety.

Signed and Sealed this

*Thirtieth* Day of *June 1981*

[SEAL]

*Attest:*

RENE D. TEGTMEYER

*Attesting Officer*

*Acting Commissioner of Patents and Trademarks*